US006494739B1

(12) United States Patent
Vivenzio et al.

(10) Patent No.: US 6,494,739 B1
(45) Date of Patent: Dec. 17, 2002

(54) MINIATURE CONNECTOR WITH IMPROVED STRAIN RELIEF FOR AN IMAGER ASSEMBLY

(75) Inventors: Robert L. Vivenzio, Auburn, NY (US); James Edward Grecco, Camillus, NY (US); Kenneth J. Burdick, Skaneateles, NY (US); Edward Arthur Johnson, Skaneateles, NY (US)

(73) Assignee: Welch Allyn, Inc., Skaneateles Falls, NY (US)

( * ) Notice: Subject to any disclaimer, the term of this patent is extended or adjusted under 35 U.S.C. 154(b) by 0 days.

(21) Appl. No.: 09/778,296

(22) Filed: Feb. 7, 2001

(51) Int. Cl.[7] ..... H01R 13/64
(52) U.S. Cl. ..... 439/579; 439/369; 358/473
(58) Field of Search ..... 439/369, 579, 439/445, 395; 358/473

(56) References Cited

U.S. PATENT DOCUMENTS

| | | | | |
|---|---|---|---|---|
| 4,090,764 A | | 5/1978 | Malsby et al. | 439/471 |
| 4,210,380 A | | 7/1980 | Brzostek | 439/369 |
| 4,283,106 A | | 8/1981 | Bunnell | 439/571 |
| 4,773,396 A | | 9/1988 | Okazaki | 600/109 |
| 4,921,447 A | | 5/1990 | Capp et al. | 439/585 |
| 4,973,262 A | * | 11/1990 | Gerke et al. | 439/395 |
| 4,974,075 A | | 11/1990 | Nakajima | 348/75 |
| 4,993,968 A | | 2/1991 | Guletsky et al. | 439/492 |
| 5,010,876 A | | 4/1991 | Henley et al. | 600/112 |
| 5,151,039 A | | 9/1992 | Murphy | 439/70 |
| 5,190,472 A | | 3/1993 | Voltz et al. | 439/579 |
| 5,194,020 A | | 3/1993 | Voltz | 439/579 |
| 5,385,490 A | | 1/1995 | Demeter et al. | 439/579 |
| 5,427,087 A | | 6/1995 | Ito et al. | 128/4 |
| 5,454,366 A | | 10/1995 | Ito et al. | 128/4 |
| 5,501,612 A | | 3/1996 | Green | 439/499 |
| 5,571,035 A | | 11/1996 | Ferrill | 439/894 |
| 5,609,499 A | | 3/1997 | Tan et al. | 439/445 |
| 5,679,008 A | | 10/1997 | Takahashi et al. | 439/76.1 |
| 5,734,418 A | | 3/1998 | Danna | 348/76 |
| 5,754,313 A | | 5/1998 | Pelchy et al. | 358/473 |
| 5,768,771 A | | 6/1998 | O'Sullivan et al. | 29/828 |
| 5,855,493 A | | 1/1999 | Shelly | 439/465 |
| 5,857,963 A | | 1/1999 | Pelchy et al. | 600/109 |

* cited by examiner

*Primary Examiner*—P. Austin Bradley
*Assistant Examiner*—Briggitte R. Hammond
(74) *Attorney, Agent, or Firm*—Wall Marjama & Bilinski LLP

(57) ABSTRACT

A miniature wire connector for connecting a transmission cable, defined by a plurality of coaxial cables, to an electronic imager assembly. The connector includes a substantially non-conductive supporting body, and a plurality of grooves formed in the outer surface of the body. At least a portion of each of the grooves includes a layer of conductive plating formed thereon, the grooves retaining at least an axial portion of at least one coaxial cable.

18 Claims, 7 Drawing Sheets

MINIATURE CONNECTOR WITH IMPROVED STRAIN RELIEF FOR AN IMAGER ASSEMBLY

FIELD OF THE INVENTION

The present invention relates to the field of coaxial cable connectors for electronic imager assemblies, and more particularly to features for relieving strain on coaxial cables that connect an electronic imager assembly to a signal processor.

BACKGROUND OF THE INVENTION

Coaxial cables have long been used to connect electrical devices to other electrical apparatus. A typical coaxial cable consists of an outer sheath enclosing a center conductor wire. The center conductor wire carries electrical signals, while the outer sheath provides electrical shielding. When such cables are used, it is well-known to provide some type of strain relief mechanism to alleviate stresses caused in the electrical connection between the coaxial cable wires and an interconnected electrical device. It is necessary that the strain relief provides adequate absorption of any pulling or twisting stresses placed on the coaxial cable wires in order to improve the reliability of the connection and prevent cable disconnection problems.

A particular field in which coaxial cables are used is that of medical or industrial imaging in which imaging devices such as endoscopes or borescopes utilize coaxial cables to connect different electrical devices with a miniature electronic imager and its associated circuitry.

For example, as shown in FIGS. 1, 2, and 12, a known video endoscopic apparatus 10, partially shown, typically employs a plurality of coaxial cables 12 to interconnect an electronic imager assembly 20 with a signal processor 13. The signal processor 13 receives the electrical signals produced by the electronic imager assembly 20 and processes the signals into a suitable video output signal. The signal processor 13 is connected to a video monitor 14, a video recorder 15, or other video peripheral device capable of handling the output video signal. The electronic imager assembly 20 shown in the FIGS. includes a miniature electronic imager 22, such as a CCD, having a transparent window 21 disposed over the image recording surface of the imager. A set of fine pitch imager leads 24 extend from between the miniature imager 22 and the window 21, extending to a pair of proximally located circuit boards 41, 42 each having a plurality of electronic components 35 disposed thereupon. A transmission cable 33 includes a plurality of coaxial cables 12 which are used to transmit power to the imager assembly 20 and to transmit an electrical signal, as conditioned by some of the components 35 on the circuit boards 41, 42 from the imager 22.

Referring more specifically to FIG. 12, the imager assembly 20 is mounted in the distal end of an insertion tube or section 17 relative to a lens system which may include one or more lens elements arranged to focus a target image upon the recording surface of the imager 22. A series of light emitting ends of a fiber bundle 16 are also disposed in proximity to the distal end of the insertion portion 17.

A problem is that though electronic imager assemblies have been streamlined and improved, particularly in terms of miniaturization and space savings, there has been relatively little development in providing strain relief for the coaxial cables used with such assemblies. For example, and still referring to FIGS. 1 and 2, one method of attaching the plurality of coaxial cables 12 to an electronic imager assembly 20 is provided by solder bonding the ends of each of the center conductor wires 19 of each of the coaxial cables 12 of the transmission cable 33 to traces 34 which are provided on facing surfaces of the pair of elongated circuit boards 41 and 42 which are held in spaced relation from one another. However, in this particular arrangement, the only strain relief is provided by the traces 34, which include only a relatively small surface area for contacting the center conductor wires 19 of the coaxial cables 12. However, as electronic imager assemblies continue to shrink in size to meet the target demand for such devices, such forms of strain relief mechanisms have proven inadequate for a variety of reasons.

The above known form of strain relief results in a very stiff distal end since the individual conductors of each coaxial cable 12 are forced apart by a block of resin material 45 and then soldered to the traces 34 in a manner that increases the length of the stiff portion of the assembly. The above solution increases the risk of breaking the connections between the coaxial cable and the assembly when the assembly is bent, twisted or pulled. It would be desirable to decrease the length of this stiff portion, and thereby provide improved flexibility.

Another problem with the above cable interconnection technique is that overall down sizing of endoscopes, borescopes, and other medical and non-medical video inspection instruments has caused the wires of the coaxial cables to become relatively thin and tiny, making these wires even more structurally weak. Utilizing an epoxy or resin to hold these wires is ineffective since their fragility tends to either break the wires completely, or cause them to pull out of the resin when twisted or pulled. Thus, it would also be very desirable to increase the strength of the connection between the wires and the assembly.

A further problem is that available space is limited, meaning conventional means of strain relief, such as clips or interconnect arrays, are highly impractical. Simply put, there is insufficient volume, particularly within an endoscope or borescope, to accommodate such designs. Moreover, there is a general need in the field to minimize the overall size of the insertion portion of these instruments so as to provide improved patient comfort and allow access to small spaces. Thus, it would also be desirable to decrease the volume of space occupied by the wire connector and the electronic imager assembly.

Still a further problem is that the structural components of electronic imager assemblies are also relatively thin and weak. This makes the entire assembly extremely difficult to handle, particularly during assembly of the insertion tube. Thus, there is a need to provide additional structural support to the components of the imager assembly. Moreover, during assembly, there is likelihood that the imager assembly may become misaligned at any time. Even slight misalignments of the imager may render the instrument unsuitable for use. Though applying an epoxy resin in the space between the two hybrid circuit boards prevents the circuit boards from moving apart or closer together, the imager itself is still prone to being misaligned. Thus, it would also be highly desirable to prevent misalignment of the imager itself.

Yet another problem is that the connectors, such as previously described in the above referred to '313 patent, require many manufacturing steps to construct and consist of too many parts. For example, the connectors require hybrid boards that are bonded to a tapered block of resin encapsulating material.

In addition, once the endoscope is assembled, it is an extremely labor intensive, time consuming, and costly process to effect any repairs should they become necessary. As a result, a substantial need has arisen for a connector with an improved strain relief mechanism that is simple to construct and instal, and that will prevent coaxial cables from being detached or broken when placed under tension. Such a feature would vastly improve reliability and help ensure proper operation of the device.

SUMMARY OF THE INVENTION

It is therefore a primary object of the present invention to improve the state of the art of electronic imager assemblies.

It is still a further primary object of the present invention to improve the reliability of coaxial connection mechanisms for imaging instruments, such as endoscopes and borescopes.

It is yet another primary object of the subject invention to improve the integrity of the connection between coaxial cable wires and an electronic imager assembly.

According to a preferred aspect of the invention, a miniature wire connector is provided for relieving strain on coaxial cable wires electrically connected to circuit leads of an electronic imager assembly. The wire connector includes a substantially non-conductive body having a tapered construction. A plurality of grooves are formed on the body in which a layer of conductive plating is formed on at least a portion of each of the grooves. These grooves, formed in the outer surface of the non-conductive body, serve to retain at least a portion of the individual coaxial cable wires. The layer of conductive plating defines a conductive-portion, this plating layer being formed from a metallic or other electrically conductive material. Portions of the coaxial cable wires are placed within and connected to the grooves, with the center conductor wire of the cable being preferably soldered to the conductive-portion, and the conductive shield of the coaxial cable being preferably soldered to a different conductive-portion of the non-conductive body. The conductive shield may be a braided wire, serve wire, foil or plated conductive material.

The miniature wire connector may further include a recess formed in an upper or front surface of the body for fixedly retaining the electronic imager assembly. This recess includes at least one pair of substantially parallel attachment lugs used for bonding to the circuit leads of the electronic imager sensor assembly, and to fix that assembly in a stable position. The attachment lugs have at least one bonding surface for bonding to each of the hybrid circuit leads. The miniature wire connector may further include a cross-groove for providing an electrical connection to the outer sheath of the coaxial cable. The cross-groove is preferably filled with a conductive metal. The body of the wire connector may further include a fixturing hole therethrough for use during wire attachment.

The miniature wire connector is preferably used as part of a video inspection instrument, such as an endoscope or borescope. The video inspection instrument includes a tubular insertion portion capable of being positioned within a tortuous cavity, the instrument further having an optical system disposed within the insertion portion. The electronic imager assembly is disposed in relation to the optical system. According to the invention, the electronic imager assembly includes a miniature electronic imager having an image recording surface arranged to receive a focused optical signal from the optical system, a transparent window disposed over the image recording surface, and a plurality of fine pitch imager leads extending between the image recording surface and the transparent window. As noted above, the miniature wire connector is used to connect a transmission cable to the electronic imager assembly, the transmission cable including a plurality of coaxial cables. The video inspection instrument also may optionally include a plurality of electronic components for operating the miniature electronic imager, wherein at least a portion of the electronic components are substantially planarly disposed in relation to the optical system, thereby providing a compact assembly.

According to a second embodiment of the present invention, a miniature wire connector for connecting a transmission cable to an electronic imager assembly is provided.

The transmission cable is preferably the same design as that described above. In this embodiment, however, the miniature wire connector includes a substantially non-conducting center-conductor termination plate, retaining means defined in the center-conductor termination plate for retaining the electronic imager assembly on a first end surface thereof, and a plurality of grooves disposed along exterior surfaces of the center-conductor termination plate. Each of the grooves include an electrically conductive portion for retaining at least one center conductor wire of at least one individual coaxial cable, a shield termination plate, and a plurality of complementary grooves disposed along exterior surfaces of the shield termination plate for retaining a portion of a coaxial cable.

According to a third embodiment of the present invention, a miniature wire connector includes a substantially non-conducting supporting body. The wire connector, according to this embodiment, further includes retaining means defined in the supporting body for retaining an electronic imager assembly on a first end surface thereof, and a plurality of grooves disposed along exterior body surfaces for receiving at least one center conductor of at least one coaxial cable. According to this embodiment, each of the grooves has an electrically conductive portion for retaining at least a portion of at least one coaxial cable wire.

Another advantage of the present invention is that the layer of conductive plating in each groove of the described wire connector allows a large portion of the center conductor of the coaxial cable to be soldered to the conductive portion. Since more surface area of the center conductor is soldered to the groove, strain relief provided by the present connector is far superior to that of known connectors.

Yet another advantage of the present invention is that a more substantial length of the coaxial cable may be attached to the connector body.

Yet another advantage of the present invention is that the attachment lugs support and fixedly retain the sensor unit, the lugs also maintaining accurate alignment of the electronic imaging assembly.

Yet another advantage of the present invention is that the non-conductive body of the wire connector is formed using a minimum number of manufacturing and assembly steps.

Yet another advantage of the present invention is to allow for further imager assembly miniaturization.

Yet another advantage of the present invention is to allow the use of shielded and non-shielded wires.

These and other objects, features and advantages will be readily apparent from the following Detailed Description which should be read in conjunction with the accompanying drawings.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION

The following description is directed mainly to several embodiments, each relating to a video endoscopic assembly. It should be readily apparent, however, that other medical and nonmedical viewing devices, such as industrial borescopes, for example, can also utilize the inventive concepts related herein. In addition, certain terminology is used throughout the course of discussion, such as "lateral", "distal", "proximal", "front", "interior", "exterior", "upper", "lower" and "rear", among others. These terms are merely used to provide a frame of reference in regard to the accompanying drawings and are not intended to be limiting of the present invention. For example, and although the following description specifically describes a wire connector having a plurality of formed grooves, it should be noted that a singular groove construction could also be employed which covers the present concept. Moreover, though the following description refers to and describes a specific coaxial cable, it should be appreciated that the inventive concepts similarly apply to other types of cables such as single conductor cables.

Figure 1:
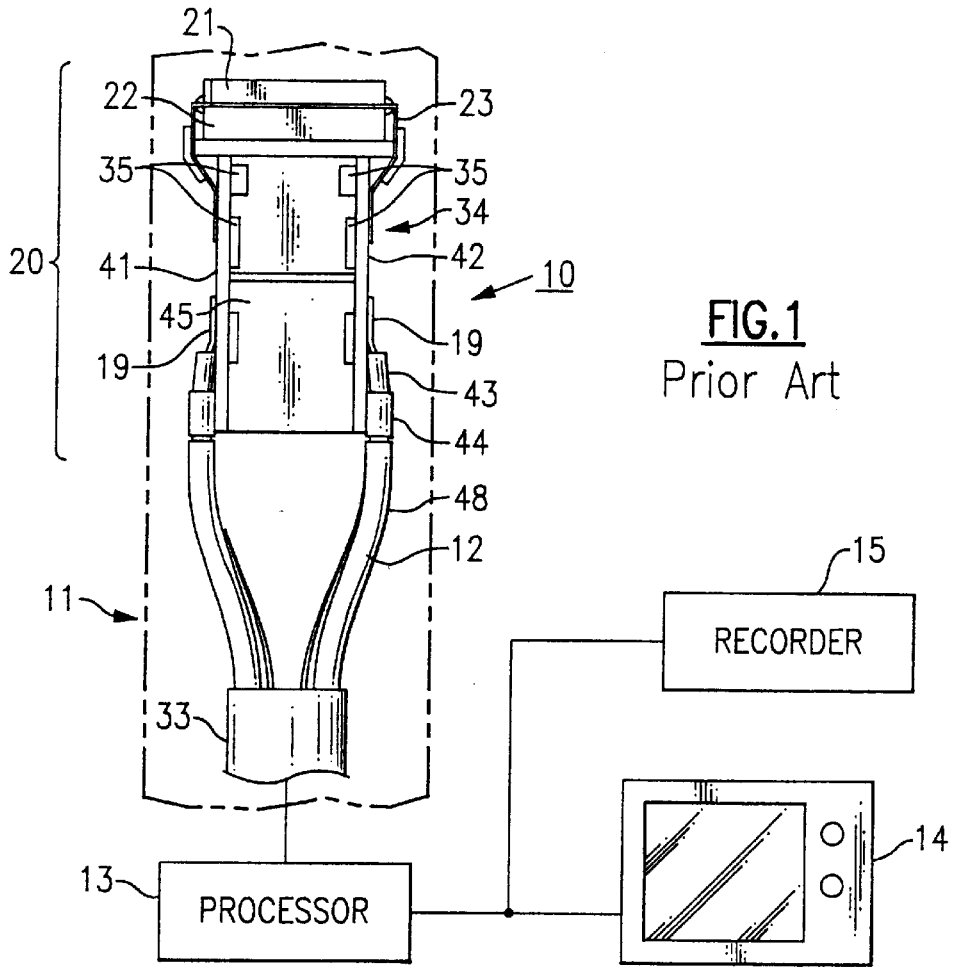
FIG.1 Prior Art
FIG. 1 is a partial schematic view showing the component parts of a prior art video endoscope.
Figure 2:
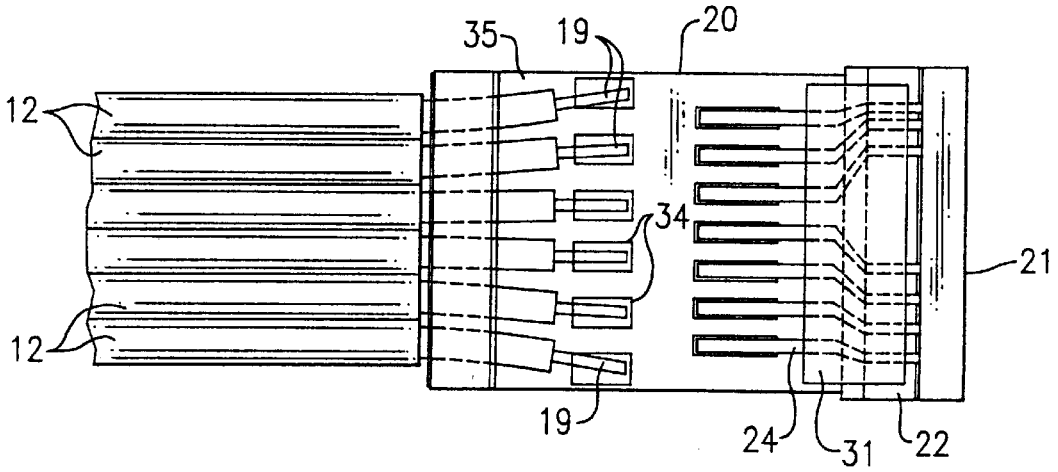
FIG.2 Prior Art
FIG. 2 is a side view of the prior art imager assembly of FIG. 1.

As described in concurrently filed and copending application Ser. No. 09/777,134, incorporated herein by reference, there is a general need to minimize the overall size of the insertion portion of a video inspection instrument in order to provide greater comfort to the patient or to allow improved access to targets whose access has been previously limited due to size limitations. To solve this problem, the above reference discloses an electronic imager assembly which includes a miniature solid state imager having an image recording surface that is arranged to receive a focused optical signal from an optical system. A transparent window is mounted in overlaying fashion over the image recording surface. A plurality of fine pitch leads extend outwardly from opposing sides of the imager from between the imager and the window. Due to the flexibility of the fine pitch leads, a number of connected electrical components permits space-saving arrangements of at least some of the components adjacent the lens cell in a distal relationship relative to the imager assembly. The above electronic imager assembly having the leads extending between the window and the image recording surface is referred to as a TAB imager assembly. An example of this form of imaging assembly is shown in FIGS. 1 and 2, and is also described in commonly assigned U.S. Pat. Nos. 5,754,313 and 5,734,418, each of which are herein incorporated by reference in their entirety.

This form of electronic imager assembly inspired the inventors to develop the improved miniature wire connector according to the present invention. These connectors are preferably used for connecting a transmission cable to a TAB electronic imager assembly, for example, the one depicted in FIGS. 1 and 2. The transmission cable includes a plurality of coaxial cables, each cable being connected by the wire connector to the electronic imager assembly. Any type of coaxial cable could be used; however, the coaxial cables 12 used in the preferred embodiment preferably including a center conductor wire 19, an electrical insulator layer 43 disposed coaxially around the center conductor wire 19, a layer of conductive shielding 44 coaxially surrounding the insulator layer, and an insulative jacket 48 which coaxially surrounds the conductive shielding.

Figure 3A:
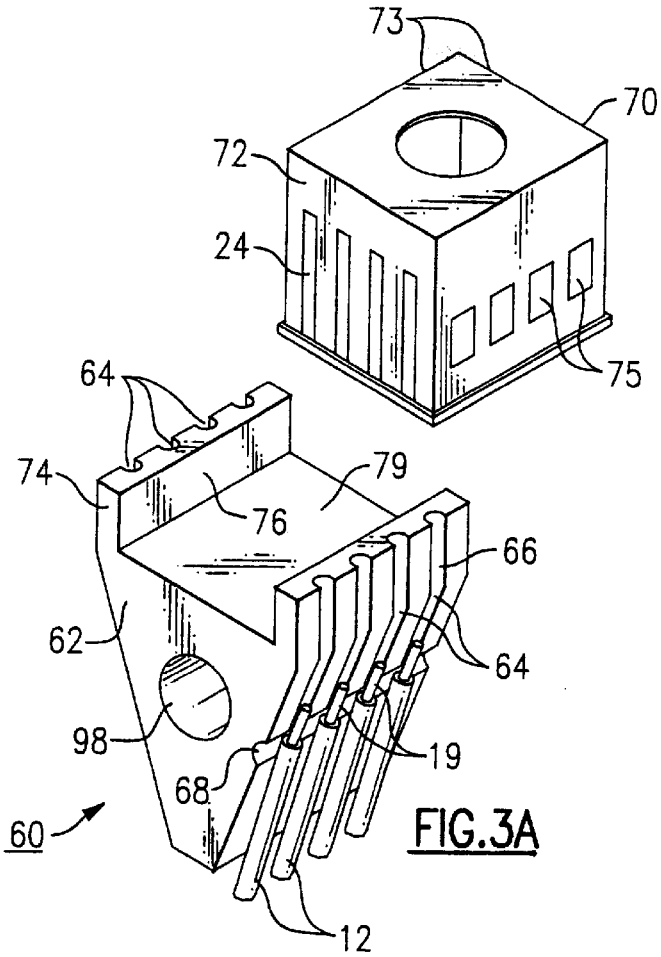
FIG. 3A is perspective view of a wire connector having a strain relief mechanism according to a first embodiment of the present invention.

Referring to FIG. 3A, there is illustrated a first embodiment of a one-piece miniature wire connector 60 in accordance with the present invention.

The wire connector 60 includes a substantially non-conductive body 62 having a plurality of exterior parallel grooves 64, and a layer of conductive plating 66 formed on at least a portion of each of the grooves. The non-conductive body 62 is preferably molded as an integral or one-piece member in which the parallel grooves 64 can be created by the mold or can be later formed by grinding or other known methods. One end of the non-conductive body 62 preferably has a tapered construction which allows the individual coaxial cables 12 of the transmission cable 33 to fall along a natural path on the outside of the supporting body 62. This arrangement reduces the stiffness of the entire assembly which results in less strain on the cables and helps prevent them from breaking during use.

The grooves 64 extend along a portion of the length of the supporting body 62, though depending on the application the grooves may alternately other or the entirety thereof, the grooves serving to retain at least an axial portion of the individual coaxial cable wires. Preferably, the coaxial cables 12 lie within the groove 64 such that a corresponding cable is at least partially embedded in the non-conductive body 62. The layer of conductive plating 66 defines a conductive-portion, the layer being preferably formed from a metallic material, although any known electric conductor could be utilized. One purpose of the conductive plating layer 66 is to provide a connection that carries an electrical signal between the coaxial cable wire 12 and the hybrid leads of the imager assembly. Another purpose of the conductive plating layer 66 preferably takes the form of a printed circuit that electrically connects the respective conductive shields. The above-described layer 66 also provides a large bonding surface for the solder used to join the coaxial cables to the conductive portion of the supporting body 62 of the wire connector 60. A pair of cross grooves 68 (only one of which is shown in FIGS. 3A, 3C and 3D) extend transversely at the proximal end of the grooves 64. These cross grooves 68 may have a conductive layer 66 also, but vertical grooves and cross grooves do not have connecting conductive layers unless it is desired.

The miniature wire connector 60 preferably includes a recess 79 formed in an upper surface of the supporting body 62 for fixedly retaining an electronic imager assembly 70 relative to the upper surface of the body. The electronic imager assembly 70 shown herein includes a cubic supporting block 72 comprising circuit boards 73, some of each of which include electronic components (not shown) disposed on exterior surfaces thereof. Additional details relating to the electronic imager assembly are provided in commonly assigned U.S. Ser. No. 09/777,134 previously incorporated by reference.

This recess 79 is preferably defined by at least one pair of substantially parallel attachment lugs 74, each of which of each includes interior facing bonding surfaces 76 used for bonding to the hybrid circuit leads 75 of the imager assembly 70. These bonding surfaces 76 are preferably formed as printed circuits. The grooves 66 extend upwardly along the outer surface of the supporting body 62 and terminate at the pair of attachment lugs 74. The interior facing bonding surfaces 76 thus provide an electrical path between the grooves 66 and hybrid circuitry (such as an amplifier) located on the circuit boards 73 of the imager assembly 70. The interior facing bonding surfaces 76 also serve to hold the imager assembly 70 in position by attachment to the hybrid circuit leads 75. In the meantime, fine pitch imager leads 24 extending from between the imager and transparent window are also attached to the circuit boards 73 of the mounting block 72. The recess 79 is sized to be substantially identical in shape to the imager assembly 70, thereby allowing the attachment lugs 74 to securely fix the imager assembly in position and even further prevent movement of the imager assembly. Similarly, it should be realized that the recess 79 can define any geometrical shape useful for securely fixing the imager assembly 70 in position. Securely anchoring the imager assembly 70 is critical in order to maintain focus of the imaging instrument.

Figure 3B:
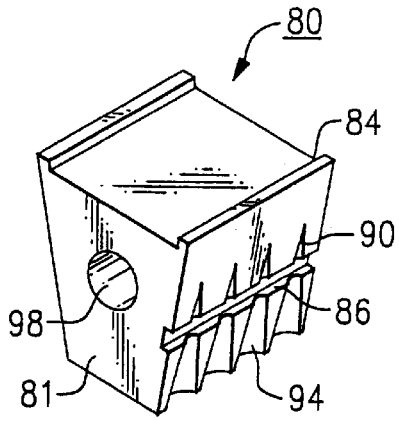
FIG. 3B shows a variation of the wire connector of FIG. 3A.
Figure 3C:
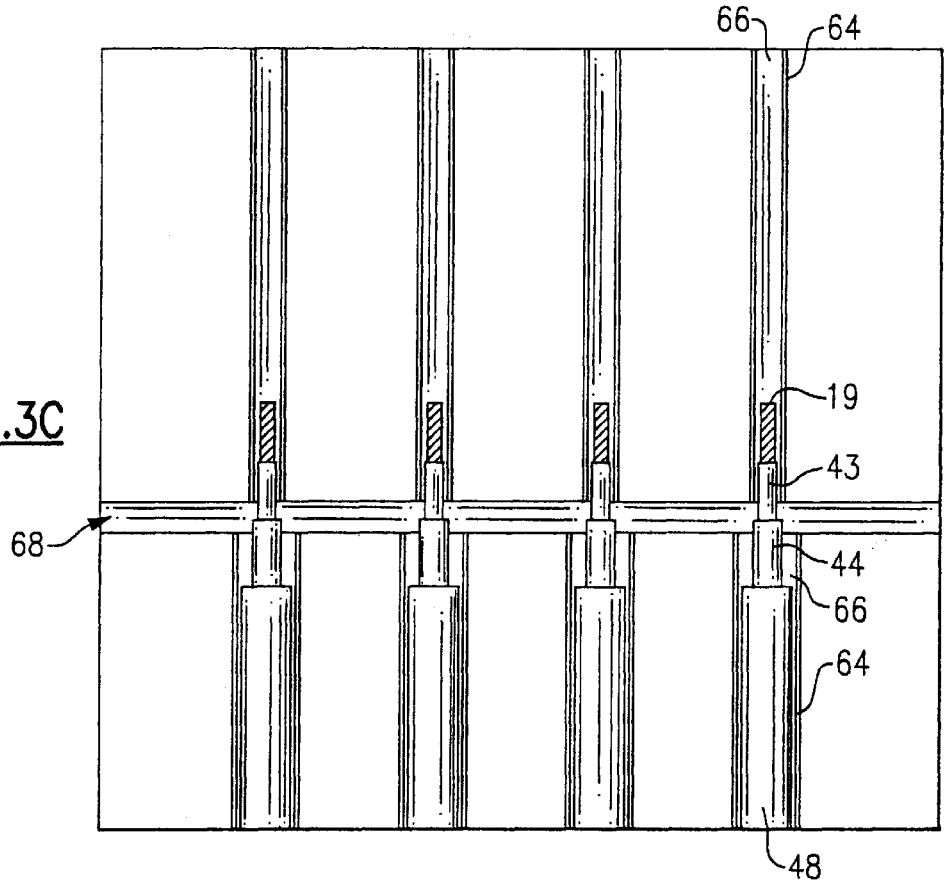
FIG. 3C is an enlarged view of the connection of the coaxial wires within the vertical grooves of the wire connector of FIG. 3A.
Figure 3D:
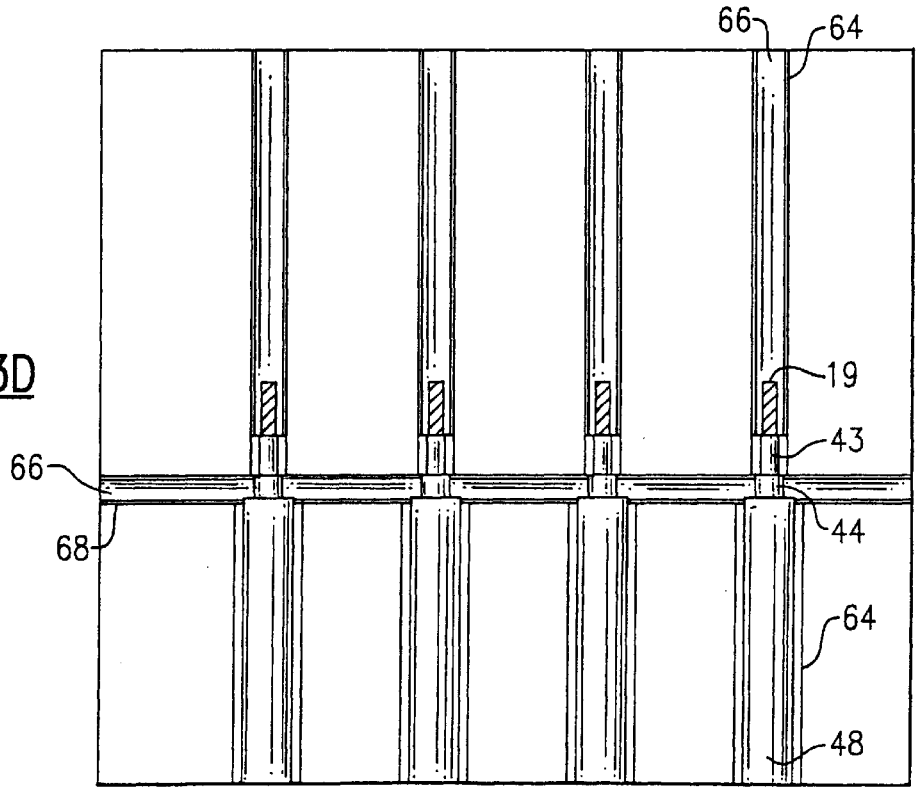
FIG. 3D is an enlarged view of the connection of the coaxial wires within the vertical and transverse (cross) grooves of the wire connector of FIG. 3A.
Figure 6:
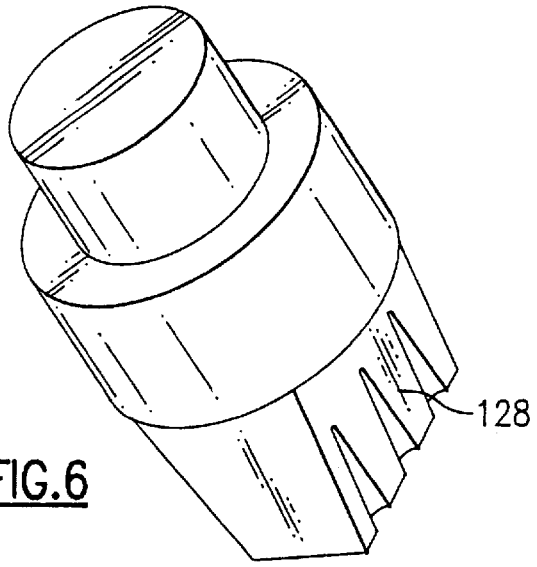
FIG. 6 is a view of the wire connector shown in FIG. 4.
Figure 7:
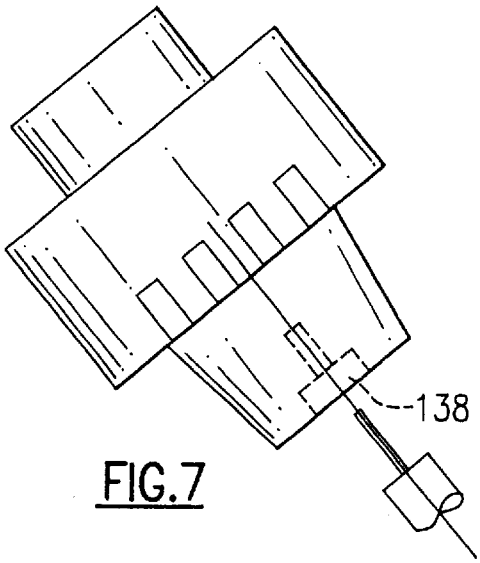
FIG. 7 is a side view of the wire connector shown in FIG. 4, just prior to insertion of the cable.

A variation of the wire connector 80 having a non-conductive supporting body 81 is shown in FIG. 3B. For the sake of clarity, similar parts are herein labeled with the same reference numerals. More particularly and according to this version, the body 81 includes a plurality of exterior grooves 82, each of the exterior grooves according to this embodiment including a transverse separating cross-groove 86. Using this construction, the exterior grooves 82 are therefore separated into two regions, namely, upper groove regions 90 which are attached to the center conductor wires, and lower groove regions 94 used for attaching a ground braid of each coaxial cable. Alternatively, the cross-groove 86 can be filled with a conductor to form a grounding bus which is used to ground the conductive grounding braid of the coaxial cable (not shown in this FIG. 3B, but clearly shown in FIGS. 3A and 3C with regard to the wire connector 60).

Referring to FIGS. 3A and 3B, each of the non-conducting supporting bodies 60, 80 may further include a lateral fixturing hole 98 extending through the entirety of the body for use during wire attachment. This lateral fixturing hole 98 serves a variety of functions, including storage of electrical components or alternate use in conjunction with a fixturing pin (not shown) to provide anchoring of the supporting body within the insertion portion of a videoized instrument.

In operation, and referring to FIGS. 3A and 3C, part of the insulating jacket 48 of the coaxial cable 12 is stripped away to expose the individual conductive shield 44. The insulative jacket 48 tightly holds the individual conductive shield 44 together. Portions of the coaxial cables 12 are then placed within and connected to the grooves 64. As discussed above, the center conductor wire 19 of each cable 12 is preferably soldered to the conductive-portion 66, while the insulative jacket 48 is preferably attached to the non-conductive portion of the outer surface of the supporting body 62. By soldering the center conductor wire 19 to the conductive-portion 66 of the wire connector 60, a greater surface area of the center conductor wire 19 is soldered.

When attached, the center conductor wire 19 of each coaxial cable 12 extends slightly past the end of the supporting body 60, and may also be soldered to the adjacent hybrid leads 75 to connect the leads to a signal processing portion of the unit. The hybrid circuitry typically includes amplifiers that drive the image signals along the transmission cable 33 to the signal processing portion. If necessary, however, the conductive shield 44 can also be soldered to the transverse cross groove 68 which serves as a grounding bus for each of the conductive shielding portions, as shown in FIG. 3D.

As previously noted, this embodiment of the present invention is advantageous in that a one-piece conductive portion has a layer of conductive plating along each groove 64 to allow the center conductor wire 19 to be soldered to the conductive portion 66. Soldering the wires 19 provides strain relief far superior to that of known connectors. Moreover, the imager assembly 70 is fully retained by the wire connector 60. The attachment lugs 74 of the supporting body 62 of the described wire connector 60 maintain accurate alignment of the imager assembly 70. Moreover and as noted above, the tapered design of the supporting body 62 allows each individual coaxial cable 12 to fall along the outer surface of the supporting body more naturally. Because the grooves 64 allow each entire coaxial cable 12 to rest within the outer surface of the supporting body 62, and further because the imager assembly 70 is disposed on part of the supporting body 62, the region where the center conductor wire 19 connects to the imager, the assembly is less stiff and therefore, has greater flexibility. The design also helps to prevent the center conductor wire 19 from becoming detached or separated, and strain placed on the coaxial cables 12 is substantially relieved. At the same time by tapering one end of the supporting body 62, the stiffness of each coaxial cable 12 is substantially reduced. As a result, any coaxial cable connections are less likely to break while the attached imager assembly 70 is less likely to shift or become misaligned.

Referring to FIGS. 4–8, there is illustrated a second embodiment of a miniature wire connector 108 in accordance with the present invention. According to this embodiment, the miniature wire connector 108 includes a substantially non-conducting supporting body 112, the body having retaining means 116 for retaining an electronic imager assembly on a first end surface 122 thereof, and a plurality of exteriorly disposed grooves 124 extending along exterior surfaces 128 of the body. Each of the grooves 124 have an electrically conductive portion 132 for retaining at least a portion of at least one coaxial cable wire.

Figure 4:
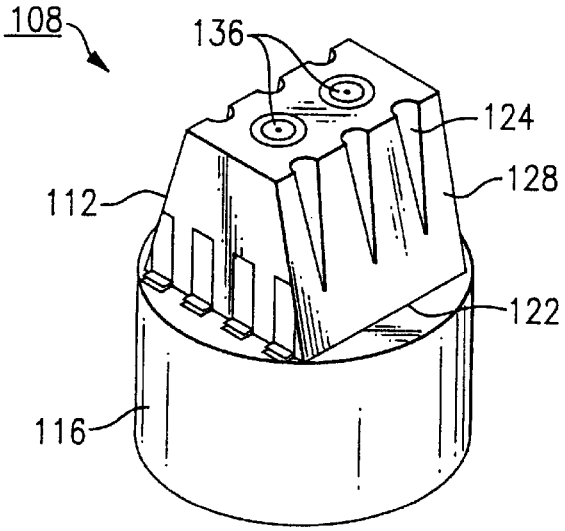
FIG. 4 is perspective view of a wire connector having a strain relief mechanism according to a second embodiment of the present invention.
Figure 5:
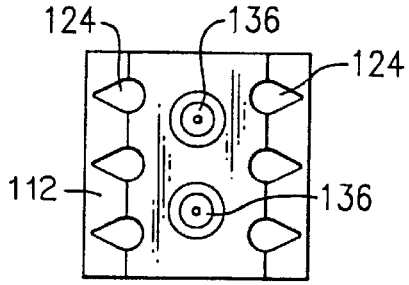
FIG. 5 is a bottom view of the wire connector shown in FIG. 4.
Figure 8:
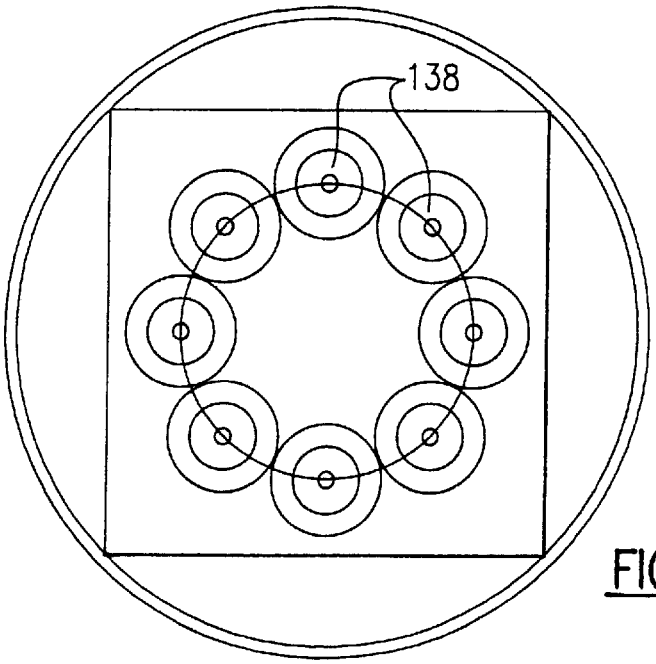
FIG. 8 is a bottom view of the connector according to the second embodiment having a plurality of sockets.

The tapered, substantially non-conducting supporting body 112 includes at least one socket 136 for receiving at least one center conductor of a coaxial cable, and preferably includes a plurality of sockets 138 as shown in FIGS. 4, 5, and 8. The retaining means 116 advantageously allows for axial adjustment of a lens cell with respect to the first end surface to focus the imager. The socket 136 can be any known means for connecting or terminating a coaxial cable. As shown in FIG. 8, a similar connector may also include a socket 138 for each center conductor. The sockets 138 can further include a locking or retaining mechanism for attachment to the outer sheath or conductive shielding of the coaxial cable to help ensure that the center conductor remains connected within the socket.

Figure 9:
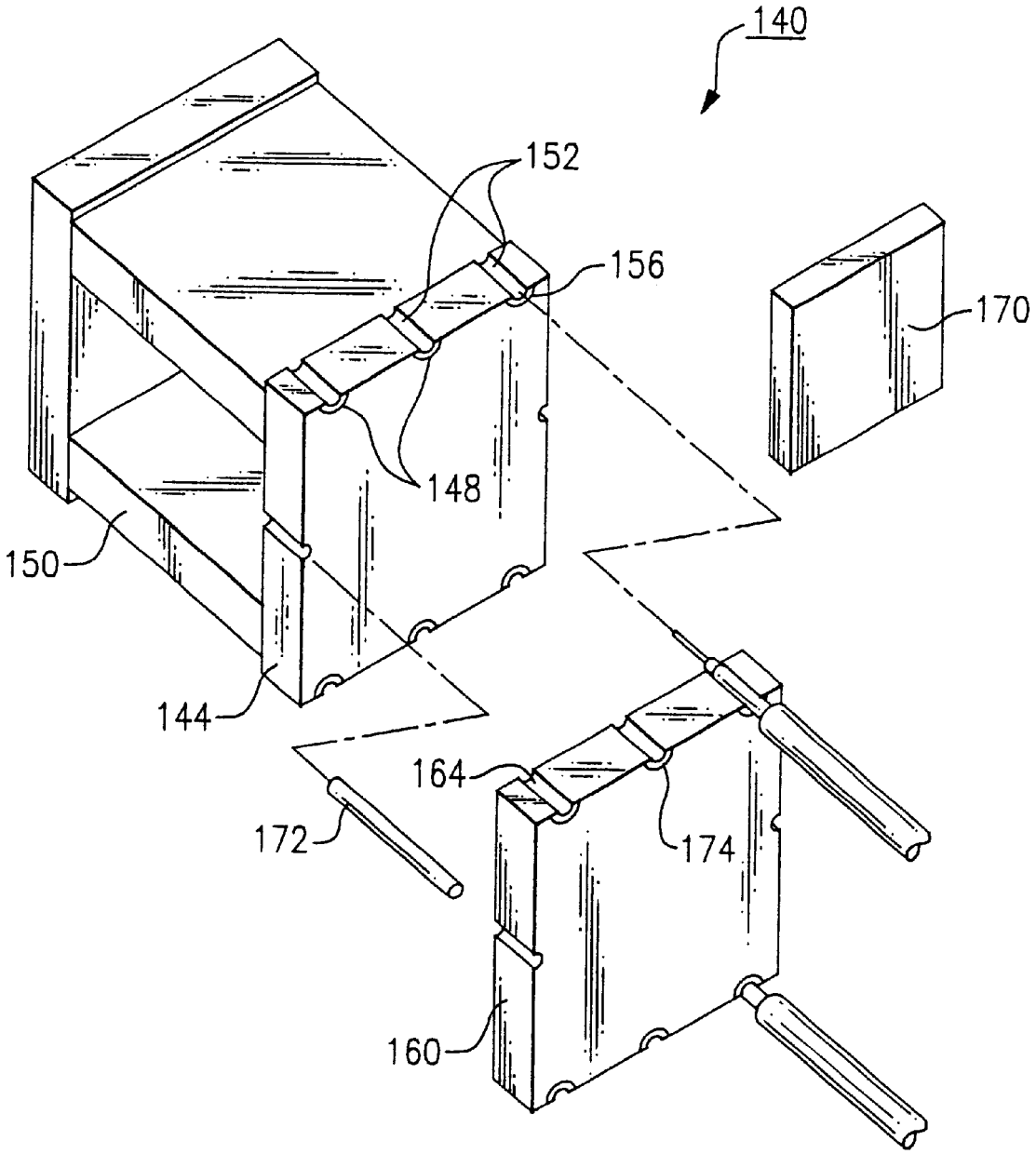
FIG. 9 is a perspective view of a wire connector according to a third embodiment of the present invention.
Figure 10:
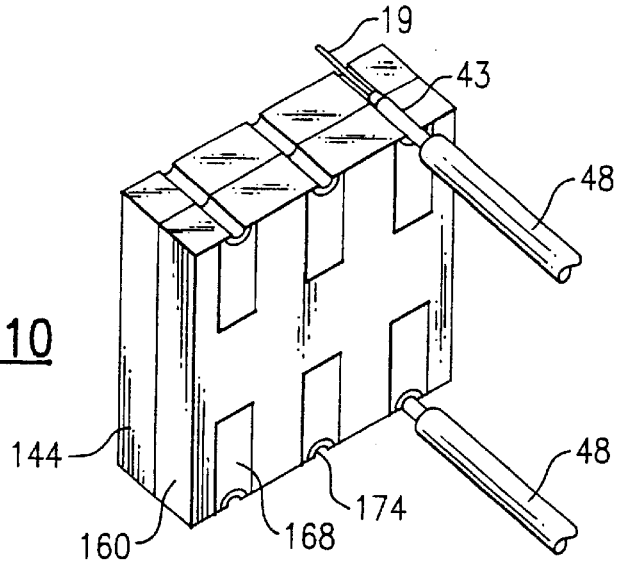
FIG. 10 is a perspective view of the center-conductor termination plate and the shield terminator plate with the coaxial cable attached according to the third embodiment of the present invention.
Figure 11:
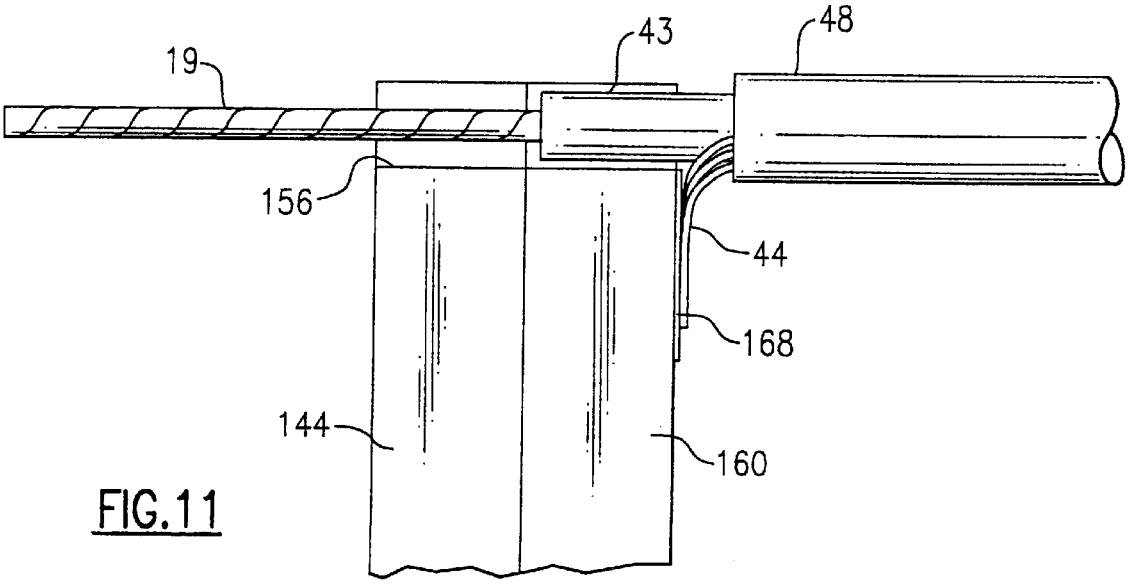
FIG. 11 is a side view of the wire connector shown in FIG. 9 with the coaxial cable attached.
Figure 12:
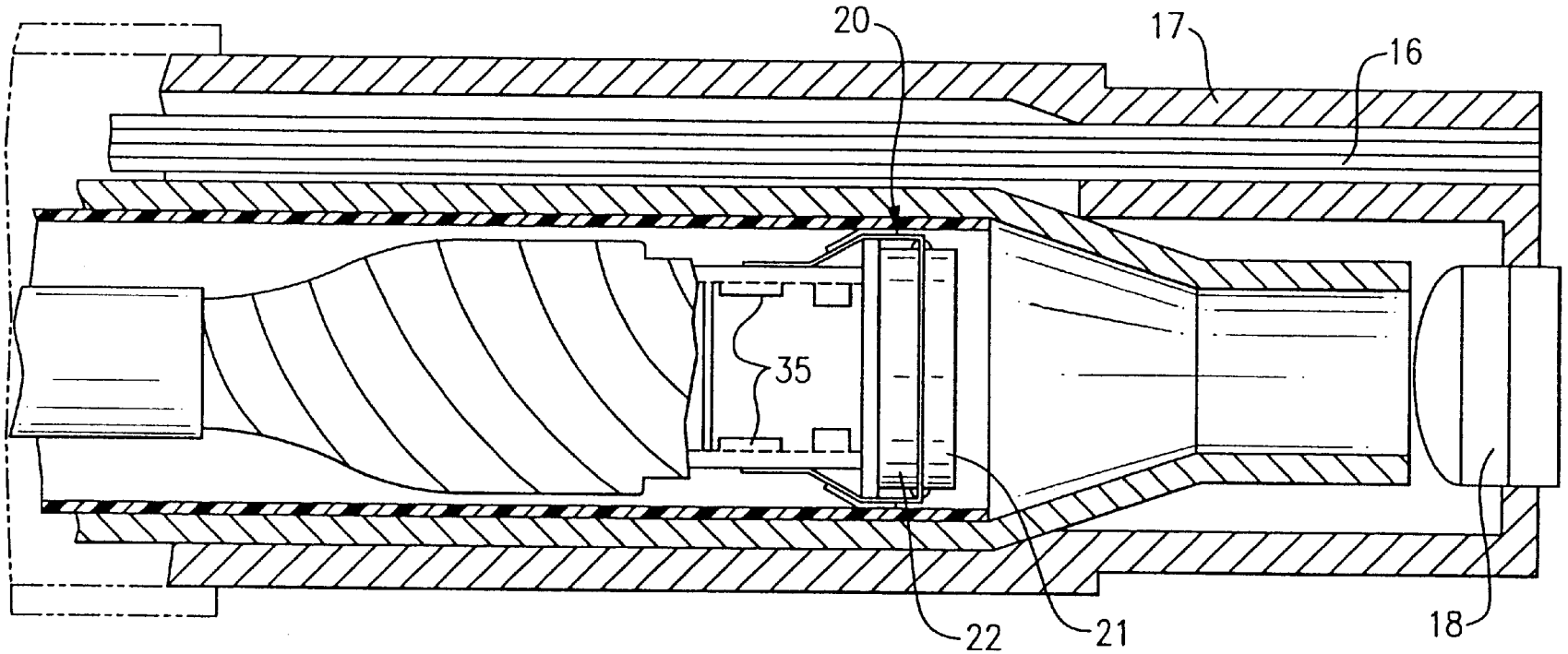
FIG.12 Prior Art
FIG. 12 is a partial enlarged side elevation of a distal end of a prior art endoscope.

Referring to FIGS. 9–11, a third embodiment of a miniature wire connector 140 includes a substantially non-conducting center-conductor termination plate 144, and retaining means 148 defined on exterior edges of the plate 144 for retaining an electronic imager assembly 150 thereon. A plurality of grooves 152 are disposed along the exterior surfaces of the center-conductor termination plate 144. Each of the grooves 152 have an electrically conductive portion 156 for retaining at least one center conductor wire of at least one individual coaxial cable.

A shield termination plate 160 having a plurality of adjacent grooves 164 disposed along exterior surfaces 168 retains an axial portion of a corresponding coaxial cable. The plurality of adjacent grooves 164 each retain the outer sheath of the coaxial cables in the connector. An insulating spacer plate 170 may optionally be positioned between the substantially non-conducting center-conductor termination plate 144 and the shield termination plate 160. As shown in FIGS. 10 and 11, each of the adjacent grooves 164 may have an electrically conductive portion 174 for grounding the conductive shielding of the cable. Each of the adjacent grooves 164 may be electrically connected to ground via a grounding pin 172 connected between the substantially non-conducting center-conductor termination plate 144 and the shield termination plate 160. A surface 164 of the shield termination plate 160 has at least one grounding bus 168 thereon for terminating the conductive shielding 44. This grounding bus 168 is preferably printed on the shield termination plate 160 as a printed circuit, which electrically connects the conductive shield 44 of each coaxial cable.

Part List for FIGS. 1–12

10 video endoscopic apparatus
12 coaxial cables
13 signal processor
14 video monitor
16 fiber bundle
15 video recorder
17 insertion tube or section
18 lens system
19 center conductor wires
20 electronic imager assembly
21 transparent window
22 miniature imager
24 imager leads
31 protective strip
33 transmission cable
34 traces
35 electronic circuit components
41 circuit board
42 circuit board
43 insulator layer
44 conductive shield
45 epoxy block
48 insulative jacket
60 wire connector
62 supporting body
64 grooves
66 conductive layer
68 cross groove
70 imager assembly
72 cubic supporting block
73 circuit boards
74 attachment lugs
75 hybrid leads
76 bonding surfaces
79 recess
80 wire connector
81 supporting body
82 grooves
84 recess
86 cross-groove
90 upper groove regions
94 lower groove regions
98 lateral fixturing hole
108 miniature wire connector
112 supporting body
116 retaining means
120 imager assembly
122 first end surface
124 grooves
128 exterior surfaces
132 conductive portion
136 socket
138 socket
140 miniature wire connector
144 termination plate
148 retaining means
150 imager assembly
152 grooves
156 conductive portion
160 shield termination plate
164 adjacent grooves
168 exterior surfaces
170 insulating spacer plate
172 grounding pin
174 conductive portion While the present invention has been particularly shown and described with reference to the preferred mode as illustrated in the drawings, it will be understood by one skilled in the art various changes in detail may be effected therein without departing from the spirit and scope of the invention as defined by the claims.

We claim:

1. In combination, a wire connector connecting a plurality of coaxial cables to an imager assembly, each coaxial cable comprising a center conductor wire, and an insulative jacket coaxially aligned around the conductor wire, the wire connector comprising:

a substantially non-conductive supporting body; and a plurality of grooves formed in an outer surface of the supporting body, the grooves retaining at least an axial portion of a coaxial cable, wherein at least a portion of each groove includes a conductive-plating layer, said supporting body including a recess formed in one surface of the supporting body that supports the imager assembly, said recess including at least one pair of substantially parallel attachment lugs for bonding circuit leads from the imager assembly and for fixedly retaining said imager assembly therein.

2. The combination as recited in claim 1, wherein the supporting body includes a through fixturing hole.

3. The combination as recited in claim 1, wherein the layer of conductive plating is metallic.

4. The combination as recited in claim 1, wherein the substantially parallel attachment lugs have at least one bonding surface for bonding to the circuit leads of the imager assembly.

5. The combination as recited in claim 1, wherein the center conductor wire is soldered to both the conductive plating layer and the circuit leads of the imager assembly.

6. The combination as recited in claim 5, further including a transverse groove for grounding conductive shielding coaxially disposed and surrounding the insulator layer which surrounds the center conductor wire.

7. The combination as recited in claim 6, wherein the transverse groove is filled with a conductive material.

8. The combination as recited in claim 7, wherein the conductive shielding is soldered to the transverse groove.

9. A video inspection instrument comprising:

a tubular insertion portion capable of being positioned within a tortuous cavity;

an optical system disposed within the insertion portion;

an imager assembly disposed in relation to the optical system, said imager assembly including a miniature electronic imager having an image recording surface arranged to receive a focused optical signal from the optical system, a transparent window disposed over the image recording surface, and a plurality of fine pitch leads extending between the image recording surface and the transparent window;

a miniature wire connector for connecting a transmission cable to the imager assembly, the transmission cable comprising a plurality of coaxial cables, each of the coaxial cables including a center conductor wire, an electrical insulator coaxially disposed around the center conductor wire, conductive shielding coaxially surrounding the electrical insulator, and an insulative jacket coaxially surrounding the conductive shielding, the wire connector comprising a substantially non-conductive supporting body, a plurality of grooves formed in the outer surface of the supporting body, the grooves retaining at least an axial portion of at least one coaxial cable wire, wherein at least a portion of each of the grooves includes a formed layer of conductive plating and a recess formed in an upper surface of the supporting body, the recess being formed on a distal surface of the supporting body and including at least one pair of substantially parallel attachment lugs for fixedly retaining the imager assembly within said recess; and a plurality of electronic components for operating the miniature electronic imager, wherein at least a portion of the electronic components are substantially planarly disposed in relation to the optical system, thereby providing a compact assembly.

10. In combination, a wire connector providing strain relief to at least one transmission cable interconnected to a TAB imager assembly, the at least one transmission cable comprising a plurality of coaxial cables, the coaxial cables each comprising a center conductor wire, an electrical insulator around the center conductor wire, conductive shielding surrounding the insulator, and an insulative jacket around the braiding , the connector comprising:

a substantially non-conducting supporting body;

a recess defined in the supporting body fixedly retaining said imager assembly on a first end surface thereof; and a plurality of grooves disposed along exterior surfaces of the supporting body, each of the grooves having an electrically conductive portion that retain at least a portion of at least one coaxial cable wire.

11. The combination as recited in claim 10, wherein the substantially non-conducting supporting body includes at least one socket for receiving at least one center conductor of at least one coaxial cable.

12. The combination as recited in claim 11, wherein the substantially non-conducting supporting body includes a plurality of sockets.

13. The combination as recited in claim 12, wherein the retaining means allows axial adjustment of a lens cell with respect to the first end surface relative to the imaging assembly.

14. A miniature wire connector connecting a transmission cable to a TAB imager assembly, the transmission cable comprising a plurality of coaxial cables, the coaxial cables each comprising a center conductor wire, an electrical insulator around the center conductor wire, conductive shielding surrounding the insulator, and an insulative jacket around the braiding, the connector comprising:

a substantially non-conducting center-conductor termination plate;

retaining means defined in the center-conductor termination plate for retaining said TAB imager assembly;

a plurality of grooves disposed along exterior surfaces of the center-conductor termination plate, each of the grooves having an electrically conductive portion for retaining at least one center conductor wire of at least one individual coaxial cable;

a shield termination plate adjacent to said center-conductor termination plate; and a plurality of adjacent grooves disposed along exterior surfaces of the shield termination plate for retaining a portion of the at least one coaxial cable.

15. The miniature wire connector as recited in claim 14, further comprising an insulating spacer plate positioned between the substantially non-conducting center-conductor termination plate and the shield termination plate.

16. The miniature wire connector as recited in claim 14, each of the adjacent grooves having an electrically conductive portion for retaining at least a portion of at least one conductive shielding, each of the adjacent grooves being electrically connected to a ground via a grounding pin connected between the substantially non-conducting center-conductor termination plate and the shield termination plate.

17. The miniature wire connector as recited in claim 16, wherein a surface of the shield termination plate has at least one grounding bus thereon for terminating the conductive shielding of the coaxial cables.

18. A videoized instrument system comprising:

a video instrument having an insertion portion capable of placement within a cavity;

a lens system mounted in the distal end of the insertion portion;

a fiber optic bundle having a plurality of light emitting ends disposed in proximity to the distal end of the insertion portion, said lens system being arranged for focusing an image of a target onto an imager assembly, said imager assembly including:

a transparent window mounted over a miniature video imaging element, a first set of imager leads passing outwardly from between the miniature video imaging element and the transparent window to one side of the package and a second set of imager leads passing outwardly from between the miniature video imaging element and the window to the other side of the unit;

a miniature wire connector for connecting a transmission cable to said imager assembly, the transmission cable comprising a plurality of coaxial cables, each coaxial cable comprising a center conductor wire, an electrical insulator around the center conductor wire, conductive shielding surrounding the insulator, and an insulative jacket around the shielding, the wire connector comprising a substantially non-conductive supporting body, a plurality of grooves formed in the outer surface of the body, the grooves retaining at least an axial portion of at least one coaxial cable wire, wherein at least a portion of each of the grooves includes a layer of conductive plating formed thereon, and a recess formed in an upper surface of the supporting body, the recess being formed on a distal surface of the supporting body and including at least one pair of substantially parallel attachment lugs for fixedly retaining the imager package within said recess; and supporting means for supporting at least some of the electronic components within the insertion portion.

* * * * *